US008550608B2

(12) United States Patent
Kanbe et al.

(10) Patent No.: US 8,550,608 B2
(45) Date of Patent: Oct. 8, 2013

(54) INK CARTRIDGE AND INKJET RECORDING APPARATUS USING THE SAME

(75) Inventors: Tomohiro Kanbe, Nagoya (JP); Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/346,344

(22) Filed: Jan. 9, 2012

(65) Prior Publication Data

US 2012/0249692 A1 Oct. 4, 2012

(30) Foreign Application Priority Data

Mar. 29, 2011 (JP) ..... 2011-073614

(51) Int. Cl.
*B41J 2/175* (2006.01)

(52) U.S. Cl.
USPC ..... 347/86

(58) Field of Classification Search
USPC ..... 347/86
See application file for complete search history.

(56) References Cited

U.S. PATENT DOCUMENTS

| | | | | |
|---|---|---|---|---|
| 4,419,677 | A * | 12/1983 | Kasugayama et al. | 347/87 |
| 4,709,249 | A * | 11/1987 | Hanagata | 347/85 |
| 7,159,974 | B2 * | 1/2007 | Gray et al. | 347/86 |
| 7,188,937 | B2 * | 3/2007 | Wilson et al. | 347/85 |
| 2002/0063761 | A1 * | 5/2002 | Sato et al. | 347/86 |
| 2004/0223037 | A1 * | 11/2004 | Acosta et al. | 347/86 |
| 2006/0238583 | A1 * | 10/2006 | Petersen et al. | 347/86 |
| 2007/0109369 | A1 * | 5/2007 | Usui et al. | 347/86 |
| 2010/0231667 | A1 | 9/2010 | Kanbe | |

FOREIGN PATENT DOCUMENTS

| | | | |
|---|---|---|---|
| JP | 2001-301187 | A | 10/2001 |
| JP | 2003-266724 | A | 9/2003 |
| JP | 2009-132118 | A | 6/2009 |
| JP | 2010-214687 | A | 9/2010 |

* cited by examiner

*Primary Examiner* — Matthew Luu
*Assistant Examiner* — Alexander D Shenderov
(74) *Attorney, Agent, or Firm* — Baker Botts L.L.P.

(57) ABSTRACT

An ink cartridge for an inkjet recording apparatus includes a membrane for sealing an opening from which air flows out to atmosphere and introduced into an ink chamber. The membrane has a gas-permeable and liquid-impermeable characteristic. A characteristic recapture enhancement section is provided for enhancing recapturement of the gas-permeable and liquid-impermeable characteristic of the membrane. This section is operable when ink from the ink chamber clings to the membrane.

19 Claims, 9 Drawing Sheets

INK CARTRIDGE AND INKJET RECORDING APPARATUS USING THE SAME

CROSS REFERENCE TO RELATED APPLICATION

This application claims priority from Japanese Patent Application No. 2011-073614 filed Mar. 29, 2011. The entire content of the priority application is incorporated herein by reference.

TECHNICAL FIELD

The present invention relates to an ink cartridge and also to an inkjet recording apparatus provided with a cartridge mounting portion in which the ink cartridge is detachably mounted.

BACKGROUND

Inkjet recording apparatuses have been extensively known and used in various fields. The inkjet recording apparatus has a recording head formed with a plurality of nozzles. Ink droplets are selectively ejected from the nozzles onto a recording paper to record images thereon. In use, an ink cartridge is mounted on the inkjet recording apparatus to supply ink to the recording head.

The ink cartridge has an ink chamber for storing ink therein. An air-hole is formed in the ink chamber to be fluidly communicable between the ink chamber and atmosphere. Air is introduced into the ink chamber from the air-hole to replace an amount ink consumed with a corresponding amount of air. Introduction of air into the ink chamber is essential to smoothly perform ink ejection.

In order to prevent ink from being leaked from the ink chamber through the air-hole, a porous or foam membrane is affixed to the air-hole. The membrane allows air to pass therethrough but interrupts ink from passing therethrough. In some inkjet recording apparatuses, a sub-tank is mounted in a carriage together with the recording head, and an air-hole and a membrane are provided in the sub-tank rather than the ink cartridge.

There has been known an ink cartridge having a slanted air communication channel connecting the ink chamber and the air-hole. If this type of ink cartridge or an inkjet recording apparatus in which such an ink cartridge is mounted is eventually inclined, ink stored in the ink chamber may move toward the air-hole and ink may be brought into contact the membrane sealing the air-hole. If it is the case, air is difficult to pass through the membrane, so that shortage of air introduction into the ink cartridge or into the sub-tank will occur and hence smooth ink ejection cannot be achieved or ink ejection failure may occur. The problem of ink ejection failure may not be resolved even if the ink cartridge or the sub-tank is returned to the normal posture from the inclined state if ink does not return to the ink chamber from the air-hole but remains in the clinging state to the membrane. More specifically, when the ink cartridge or the inkjet recording apparatus is inclined from the normal state, ink moving toward the air-hole expels air out of the ink cartridge through the membrane. When the ink cartridge or the inkjet recording apparatus is returned to the normal posture from the inclined state, a relevant amount of air needs to be smoothly introduced into the ink chamber attendant to the movement of the ink toward the ink chamber. However, this cannot be achieved if ink still clings to the membrane. Air does not pass through the ink-clinging portion of the membrane, so that ink does not move or is difficult to move toward the ink chamber. In consequence, ink remains in contact with the membrane, thereby making it difficult to recover the air permeability of the membrane.

SUMMARY

In view of the foregoing, in accordance with one aspect of the invention, there is provided an ink cartridge including an ink chamber storing ink therein, an ink supply portion provided in the ink chamber, an air channel connected to the ink chamber and configured to introduce air into the ink chamber, a room wall defining an atmosphere communicable room connected to the air channel, the room wall being formed with an opening open to atmosphere; a membrane, and a characteristic recapture enhancement section. The membrane is provided for sealing the opening of the room wall. The membrane has a gas-permeable and liquid-impermeable characteristic. The characteristic recapture enhancement section is configured to enhance recapturement of the gas-permeable and liquid-impermeable characteristic of the membrane. The characteristic recapture enhancement section is operable when ink from the ink chamber clings to the membrane.

According to another aspect of the invention, there is provided an inkjet recording apparatus including a recording head, an ink cartridge, and a cartridge mounting portion in which the ink cartridge is detachably mounted. The ink cartridge has an ink chamber storing ink therein, an ink supply portion provided in the ink chamber and connected to the recording head, and an air channel connected to the ink chamber and configured to introduce air into the ink chamber. A room wall is provided that defines an atmosphere communicable room connected to the air channel. The room wall is formed with an opening open to atmosphere. A membrane seals the opening of the room wall. The membrane has a gas-permeable and liquid-impermeable characteristic. A characteristic recapture enhancement section is provided for enhancing recapturement of the gas-permeable and liquid-impermeable characteristic of the membrane, and is operable when ink from the ink chamber clings to the membrane.

BRIEF DESCRIPTION OF THE DRAWINGS

The particular features and advantages of the invention as well as other objects will become apparent from the following description taken in connection with the accompanying drawings, in which.

DETAILED DESCRIPTION

An embodiment of the invention will be described while referring to the accompanying drawings. In the following description, the terms "upward", "downward", "upper", "lower", "above", "below", "beneath", "right", "left", "front", "rear" and the like will be used assuming that the ink cartridge 30 or the printer 10 is disposed in an orientation in which it is intended to be used.

[Overview of Inkjet Printer 10]

Figure 1:
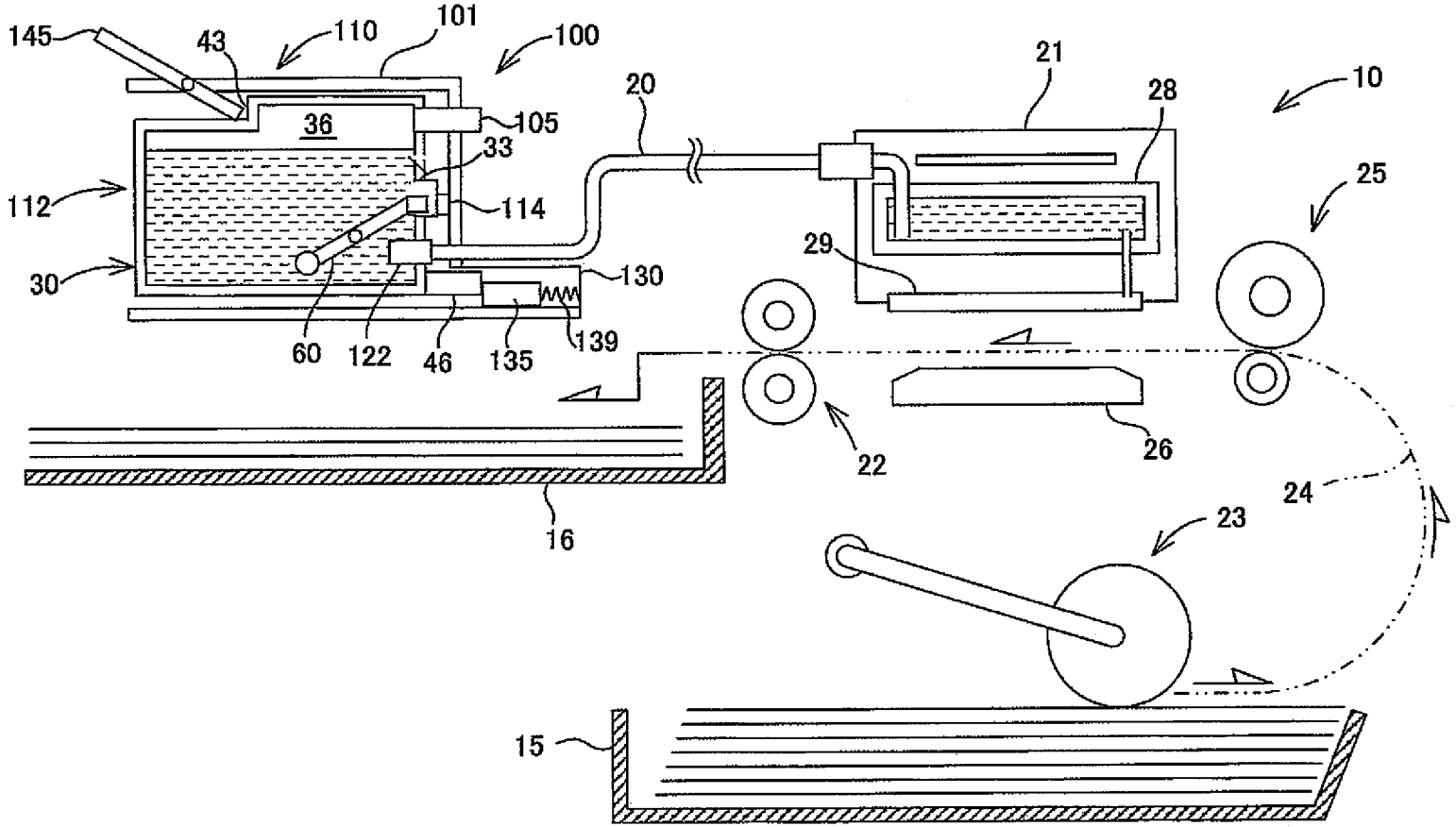
FIG. 1 is a schematic cross-sectional view showing an internal structure of an inkjet printer according to an embodiment of the invention.

An inkjet printer 10 according to the embodiment uses an inkjet recording system to record images by selectively ejecting ink droplets onto a recording paper. As shown in FIG. 1, the inkjet printer 10 includes an ink supply device 100. A cartridge mounting portion 110 is provided in the ink supply device 100. An ink cartridge 30 can be mounted in the cartridge mounting portion 110. An opening 112 is formed in one side surface of the cartridge mounting portion 110. The ink cartridge 30 is inserted into or removed from the cartridge mounting portion 110 through the opening 112. Here, the structure of the inkjet printer 10 shown in FIG. 1 is one example of an inkjet recording apparatus of the present invention.

The ink cartridge 30 stores ink that can be used by the inkjet printer 10. While the ink cartridge 30 is mounted in the cartridge mounting portion 110, the ink cartridge 30 is connected to a recording head 21 by an ink tube 20. The recording head 21 is provided with a sub-tank 28. The sub-tank 28 temporarily stores ink supplied from the ink cartridge 30 via the ink tube 20. The recording head 21 selectively ejects ink supplied from the sub-tank 28 through nozzles 29 in response to image data.

The inkjet printer 10 also includes a paper tray 15 accommodating sheets of recording paper and a feeding roller 23 for feeding sheets of paper from the paper tray 15. The feeding roller 23 feeds the sheets of paper into a conveying path 24. A pair of conveying rollers 25 conveys the sheets of paper along the conveying path 24 over a platen 26. At this point, the recording head 21 selectively ejects ink droplets onto the recording paper as the paper passes over the platen 26, thereby recording an image on the paper. After the sheet of paper passes over the platen 26, a pair of discharge rollers 22 discharges the sheet of paper into a discharge tray 16 provided on the downstream end of the conveying path 24.

[Ink Supply Device 100]

As shown in FIG. 1, the ink supply device 100 is provided in the inkjet printer 10. The ink supply device 100 functions to supply ink to the ink tube 20 provided in the inkjet printer 10. The ink supply device 100 includes the cartridge mounting portion 110 in which the ink cartridge 30 can be detachably mounted. FIG. 1 shows the cartridge mounting portion 110 in which the ink cartridge 30 is mounted.

[Ink Cartridge 30]

Figure 2:
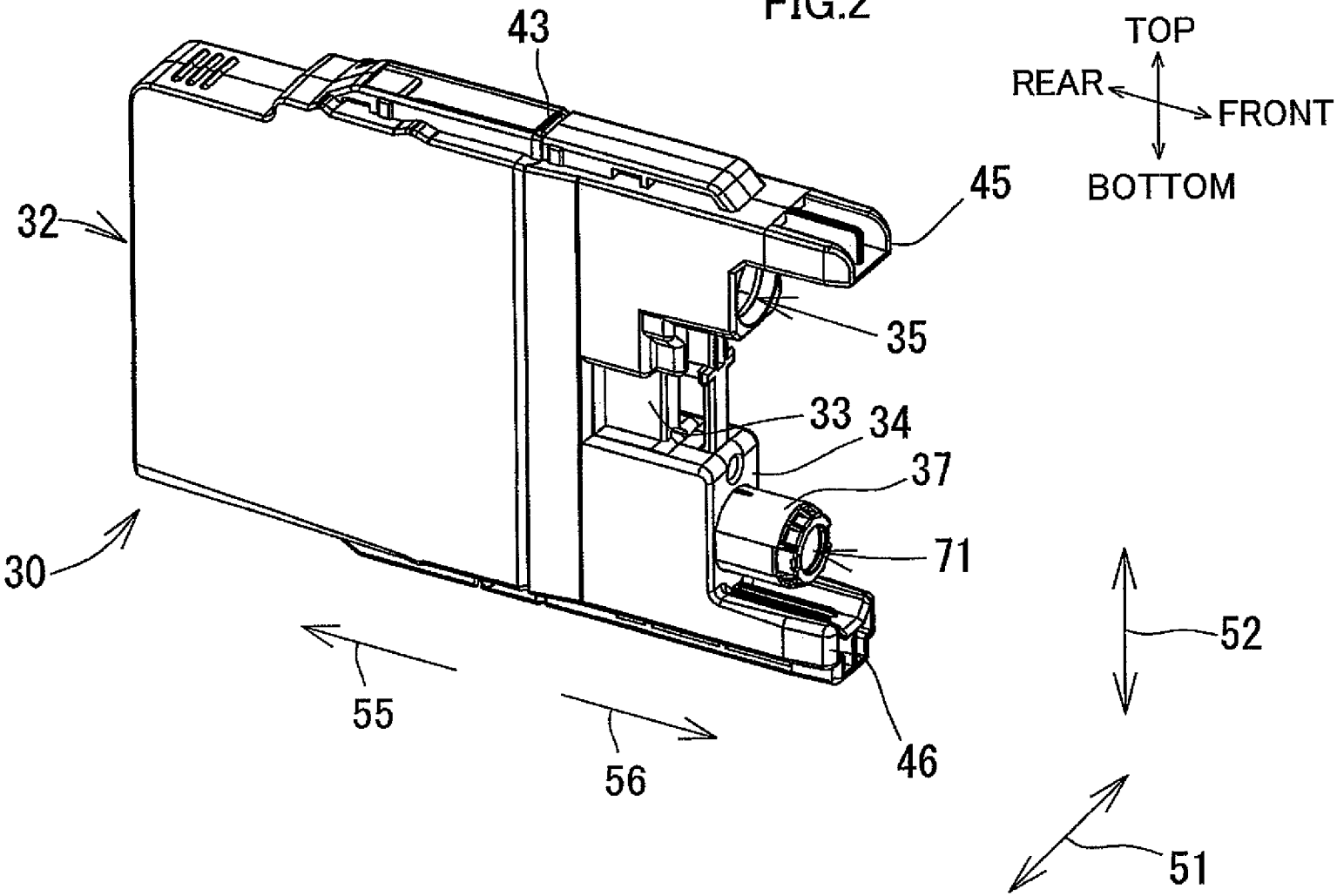
FIG. 2 is a perspective view showing an outer appearance of an ink cartridge according to an embodiment of the invention.
Figure 3:
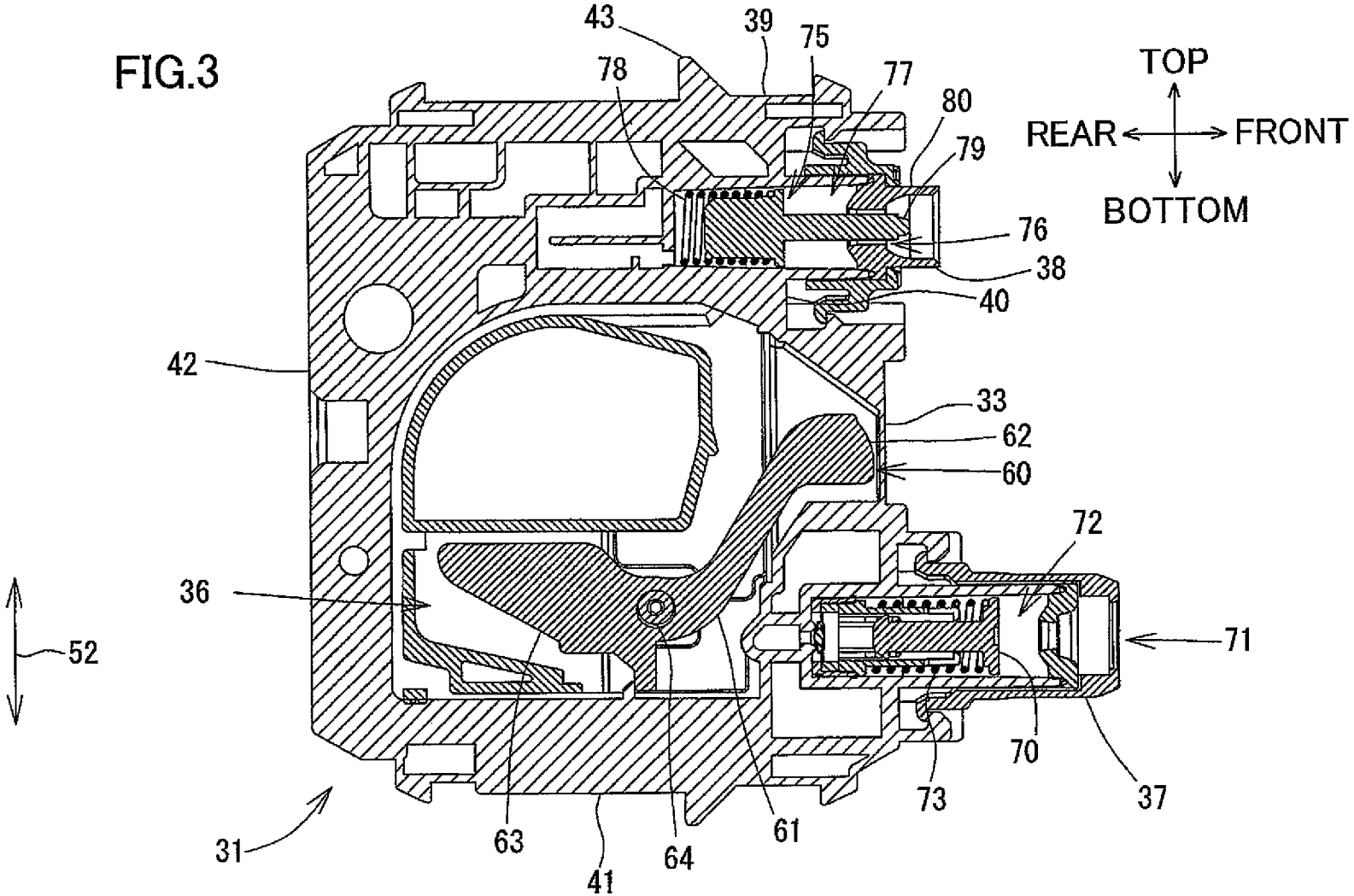
FIG. 3 is a vertical cross-sectional view showing an inner arrangement of the ink cartridge according to the embodiment of the invention.

The outer appearance of the ink cartridge 30 is show in FIG. 2, and the inner arrangement of the ink cartridge 30 is shown in FIG. 3. The ink cartridge 30 is a vessel for storing ink therein. In this embodiment, used is water soluble ink containing water as a major component. A space formed inside the ink cartridge 30 is an ink chamber 36 in which ink is stored. It is desirable that a maximum amount of ink capable of storing in the ink chamber 36 be as large as a volume of the ink chamber 36. Specifically, it is desirable that in the ink full state, the boundary between ink and air in the ink chamber 30 be upper than the position of a residual ink amount detector 33 to be described later.

An upstanding state ink cartridge 30 is shown in FIG. 2 and this state will be referred to as a normal posture of the ink cartridge 30. Therefore, one side surface of the ink cartridge 30 is a bottom and another opposing side surface thereof is a top. In use, the ink cartridge 30 needs to be inserted into the cartridge mounting portion 110 of the inkjet printer 10. In this embodiment, as shown in FIG. 1, the inkjet printer 10 is generally elongated in horizontal direction when placed in the normal posture. When the ink cartridge becomes empty with no ink remaining therein, the ink cartridge 30 is removed from the cartridge mounting portion 110 for replacement with a new one. Normally, the ink cartridge 30 is removed from and inserted into the cartridge mounting portion 110 while maintaining the normal posture. The direction in which the ink cartridge 30 is inserted into the cartridge mounting portion 110 is indicated by an arrow 56 and will hereinafter be referred to as "cartridge insertion direction 56". Also, the direction in which the ink cartridge 30 is removed from the cartridge mounting portion 110 is indicated by an arrow 55 and will hereinafter be referred to as "cartridge removing direction 55".

Figure 6:
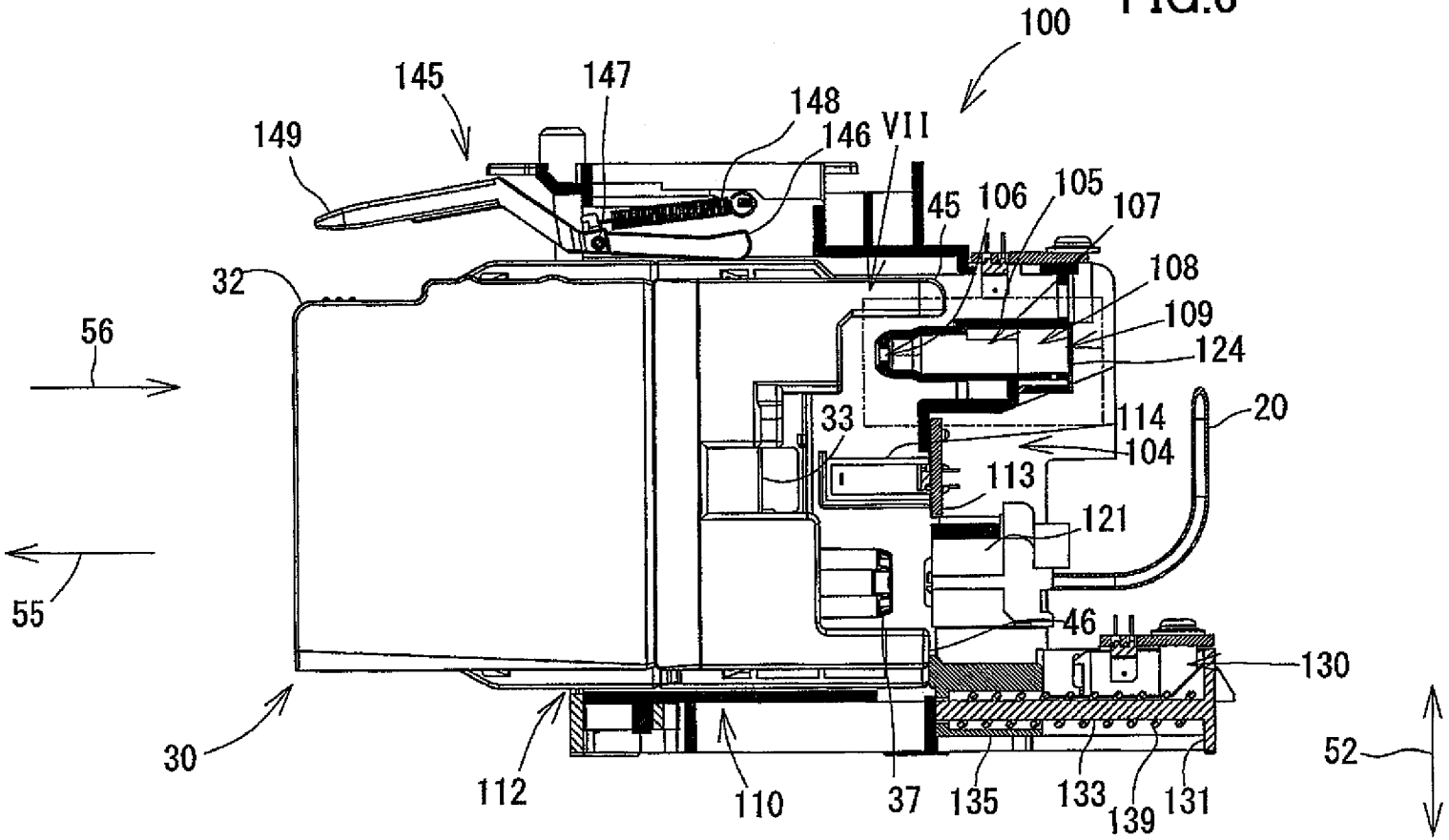
FIG. 6 is a cross-sectional view showing the ink cartridge mounted in the cartridge mounting portion.

More specifically, the ink cartridge 30 is inserted into the cartridge mounting portion 110 by moving it in the cartridge insertion direction 56 and removed from the cartridge mounting portion 110 by pulling it out in the cartridge removing direction 55 as shown in FIG. 6. Insertion and removal of the ink cartridge 30 are performed while maintaining the upstanding or normal posture of the ink cartridge 30 as shown in FIG. 2. In this embodiment, the cartridge removing direction 55 and cartridge insertion direction 56 are on a horizontal plane. That is, the insertion and removal of the ink cartridge 30 are performed by moving the ink cartridge 30 in a horizontal direction. The height direction 52 of the ink cartridge 30 is in coincidence with the direction of gravity.

As shown in FIGS. 2 and 3, the ink cartridge 30 includes a main unit 31 and a cover 32. An ink chamber 36 is formed in the internal space of the ink cartridge 30 for storing ink therein. The main unit 31 defines the ink chamber 36 and is covered with the cover 32. As shown in FIG. 2, the cover 32 is formed with a first arm (or interface) 45 and a second arm (or interface) 46 to be in parallel with each other. The first arm 45 projects from the front wall 34 in the cartridge insertion direction 56. The widthwise thickness, i.e., the thickness in the widthwise direction 51, of the first arm 45 is the same as the widthwise thickness of the front wall 34. The first arm 34 extends in the cartridge insertion direction 56 to a horizontal position exceeding the ink supply port 71 formed at the end of an ink supply portion 37.

While in this embodiment, the widthwise thickness of the first arm 45 is the same as that of the front wall, the first arm 45 may be of a plate-shape with a widthwise thickness smaller than that of the front wall 34. The first arm 45 is not absolutely necessary, so it can be dispensed with.

The second arm 46 projects from the lower end of the front wall 34 of the cover 32 and extends in the cartridge insertion direction 56 to a position further than the ink supply portion 37. Therefore, when the ink cartridge 30 is fully and completely inserted into the cartridge mounting portion 110, the leading edge of the second arm 46 is brought into a position ahead of the ink supply portion 37. The widthwise thickness of the second arm 46 is the same as that of the front wall 34. Similar to the first arm 45, the second arm 46 may not be provided.

As shown in FIGS. 2 and 3, the main unit 31 of a substantially parallelepiped is provided inside the cover 31. The main unit 31 is generally of a flat shape having a thin widthwise thickness and long vertical (in the height direction) and horizontal lengths relative to the widthwise thickness. The main unit 31 has a front wall 40, a rear wall 42, an upper wall 39, and a lower wall 41 which are integrally formed as one unit. The front wall 40 and the rear wall 42 are spaced apart and opposes in the cartridge insertion/removing directions 56, 55. The front wall 40 and rear wall 42 are bridged by the upper wall 39 extending between the respective upper portions of the front wall 40 and the rear wall 42. The front wall 40 and rear wall 42 are also bridged by the lower wall 41 extending between the respective lower portions of the front wall 40 and the rear wall 42. Insertion of the ink cartridge 30 into the cartridge mounting portion 110 is performed by directing the front wall 40 of the cartridge 30 toward the cartridge mounting portion 110.

The ink chamber 36 is formed inside the main unit 31. The ink chamber 36 is a space defined by the main unit 31 and films (not shown) attached to both sides of the main unit 31. A plurality of ribs is provided in the ink chamber 36 for reinforcement purpose. The ink chamber 36 is fluidly communicable with the residual ink amount detector 33, ink channel 72, and air channel 77. Specifically, ink and air are communicable between the ink chamber 36 and its associated residual ink amount detector 33, ink channel 72, and air channel 77.

As shown in FIG. 3, the residual ink amount detector 33 is provided at the vertical center area of the front wall 40 of the main unit 31. The residual ink amount detector 33 is a flat shaped hollow member. The widthwise length of the ink amount detector 33 is much smaller than the lengths in the height direction 52 and also in the cartridge removing direction 55 (depthwise direction). As described, the residual ink amount detector 33 is fluidly communicable with the ink chamber 36. This means that no partitioning walls exist between the residual ink amount detector 33 and the ink chamber 36.

A sensor arm 60 is disposed in the ink chamber 36 and rotatably supported by a support shaft 64 extends in the widthwise direction 51. The sensor arm 60 is an 5-shaped plate member and has an indicator portion 62 at one end thereof and a float portion 63 at another end thereof. The indicator portion 62 is accommodated in the internal space of the residual ink amount detector 33.

The sensor arm 60 takes an angular position depending upon an amount of ink remaining in the ink chamber 36. Angular movements of the sensor arm 60 move the indicator portion 62 in the height direction 52 of the residual ink amount detector 33. The indicator portion 62 is brought to the uppermost position of the residual ink amount detector 33 when the ink in the ink chamber 36 is empty or near-empty whereas the indicator portion 62 is brought to the lowermost position of the residual ink amount detector 33 when the ink in the ink chamber 36 is full. The indicator portion 62 is movable between the uppermost and lowermost positions and can indicate the amount of ink remaining in the ink chamber 36 by the vertical position of the indicator portion 62 in the residual ink amount detector 33. FIG. 3 shows that the indicator portion 62 is held in the lowermost position, indicating that the ink chamber 36 is full of ink.

As shown in FIG. 3, an air hole 38 is formed in the front wall 40 of the main unit 31 at a position above the residual ink amount detector 33. The air hole 38 is formed in a cylindrically elongated portion projecting frontwardly from the front wall 40. The end face of air hole 38 is exposed outside through an opening 35 formed in the cover 32. A sleeve 80 made from a resilient material is secured to the end face of the air hole 38. An air communication port 76 is formed inside the sleeve 80, which is fluidly connected to the air hole 38. An air channel 77 is formed between the air-communication port 76 and the ink chamber 36. The air channel 77 extends horizontally. The air-communication port 76 is capable of being open and closed by means of an air communication valve 75. A coil spring 78 is provided to urge the air-communication valve 75 toward the air-communication port 76. Due to the urging force of the coil spring 78, the air-communication valve 75 is normally in intimate contact with the sleeve 80, thereby closing the air-communication port 76.

The air communication valve 75 has a rod portion 75 projecting in the cartridge insertion direction 56. When the ink cartridge 30 is mounted in the cartridge mounting portion 110, the tip end of an air channel joint 105 provided in the cartridge mounting portion 110 is brought into abutment with the rod portion 79 of the air communication valve 75, causing the air communication valve 75 to separate from the sleeve 80 against the urging force of the coil spring 78. In this way, the negative pressure in the ink chamber 36 is brought to atmospheric pressure as a result of opening of the air communication hole 56. When the ink cartridge 30 is mounted in the cartridge mounting portion 110, the tip end of the air channel joint 105 is inserted into the inner space of the sleeve 80 and the inner peripheral surface of the sleeve 80 is brought into intimate contact with the outer peripheral surface of the air channel joint 105. Specifically, resilient deformation of the sleeve 80 allows the air channel joint 105 to fit into the sleeve 80.

The open/closure of the air-communication port 76 may not necessarily be performed by the air communication valve 75. Instead, opening of the air-communication port 76 may be performed by sticking the air channel joint 105 into a resilient film or rubber cock sealing the air-communication port 76 when the ink cartridge 30 is mounted in the cartridge mounting portion 110.

As shown in FIG. 3, an ink supply portion 37 is provided at the lower position on the front wall 40 of the main unit 31. The ink supply portion 37 is cylindrical and projects horizontally outwardly from the front wall 40. The ink supply portion 37 is exposed outside of the cover 32. The ink supply port 71 is formed at the tip end of the ink supply portion 37. The ink channel 72 is formed between the ink supply port 71 and the ink chamber 36 through the inner space of the ink supply portion 37. The ink channel 72 extends horizontally. The ink supply port 71 is configured to be opened or closed by the ink supply valve 70. The ink supply valve 70 is urged toward the ink supply port 71 by a coil spring 73 to thereby normally close the ink supply port 71. When the ink cartridge 30 is mounted in the cartridge mounting portion 110, an ink needle 122 (see FIG. 5) is inserted into the ink supply port 71. The ink needle 122 separates the ink supply valve 70 from the ink supply port 71 against the urging force of the coil spring 73. As a result, the ink supply port 71 is opened, thereby allowing ink in the ink chamber 36 to flow in the ink needle 122 provided in the cartridge mounting portion 110 through the ink channel 72.

The open/closure of the ink supply port 71 may not necessarily be performed by the ink supply valve 70. Instead, a resilient film or rubber cock may be employed to seal the ink supply port 71. In such cases, opening of the ink supply port 71 may be implemented by sticking the ink needle 22 into the resilient film or rubber cock when the ink cartridge 30 is mounted in the cartridge mounting portion 110.

As shown in FIG. 3, an engagement portion 43 is formed in the upper wall 39 at a position near the center in the depthwise direction. The engagement portion 43 is provided for engaging a lock lever 145 (to be described later). The engagement portion 43 is urged in the cartridge removing direction 55 when the engagement portion 43 is brought into engagement with the lock lever 145. The engagement portion 43 is an arm having vertical surfaces, a flat top surface, and a slanted surface. The engagement portion 43 is not covered by the cover 32 but exposed to outside of the cover 32.

[Cartridge Mounting Portion 110]

Figure 4:
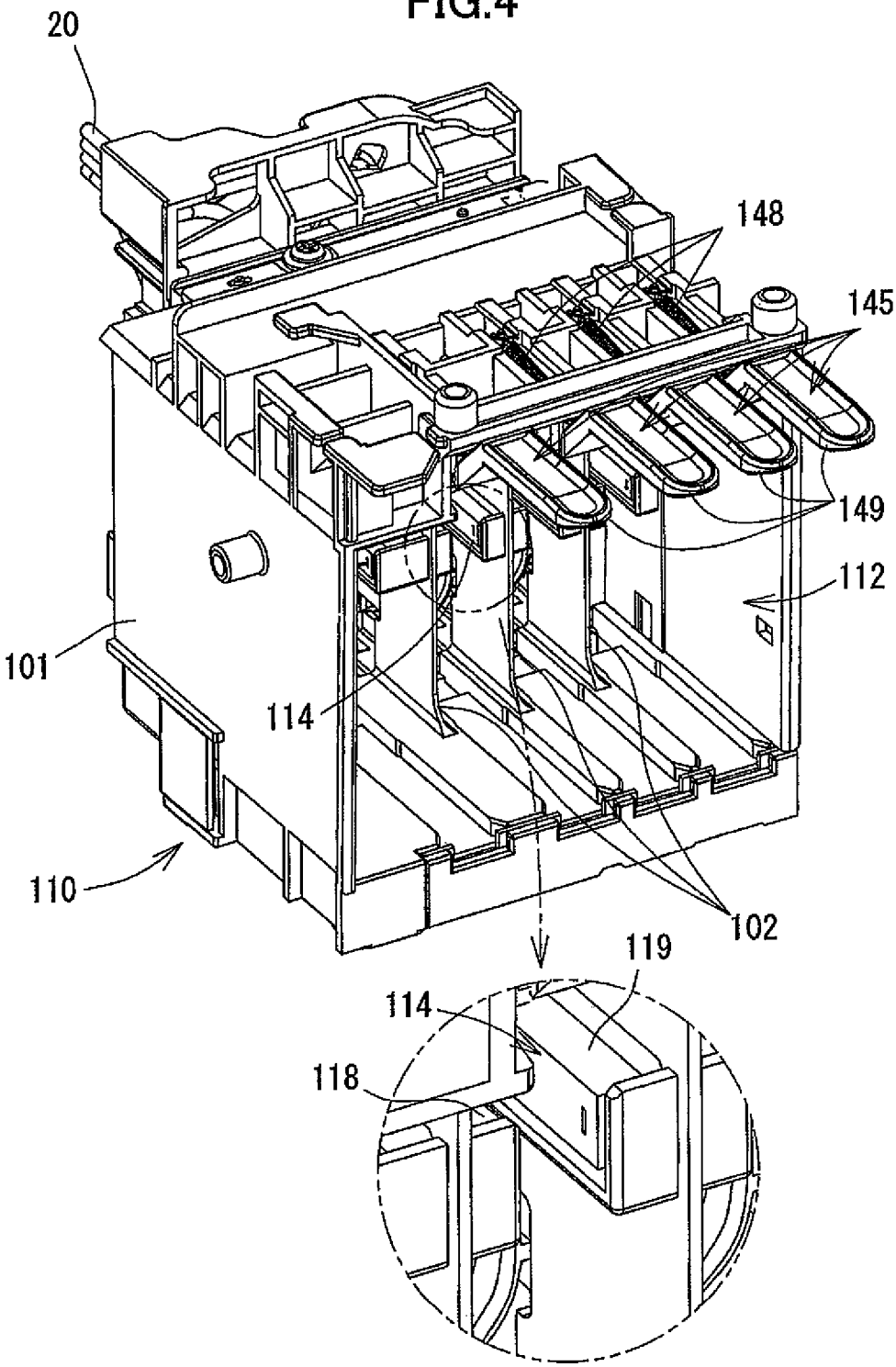
FIG. 4 is a perspective view showing a cartridge mounting portion provided in an inkjet printer.
Figure 5:
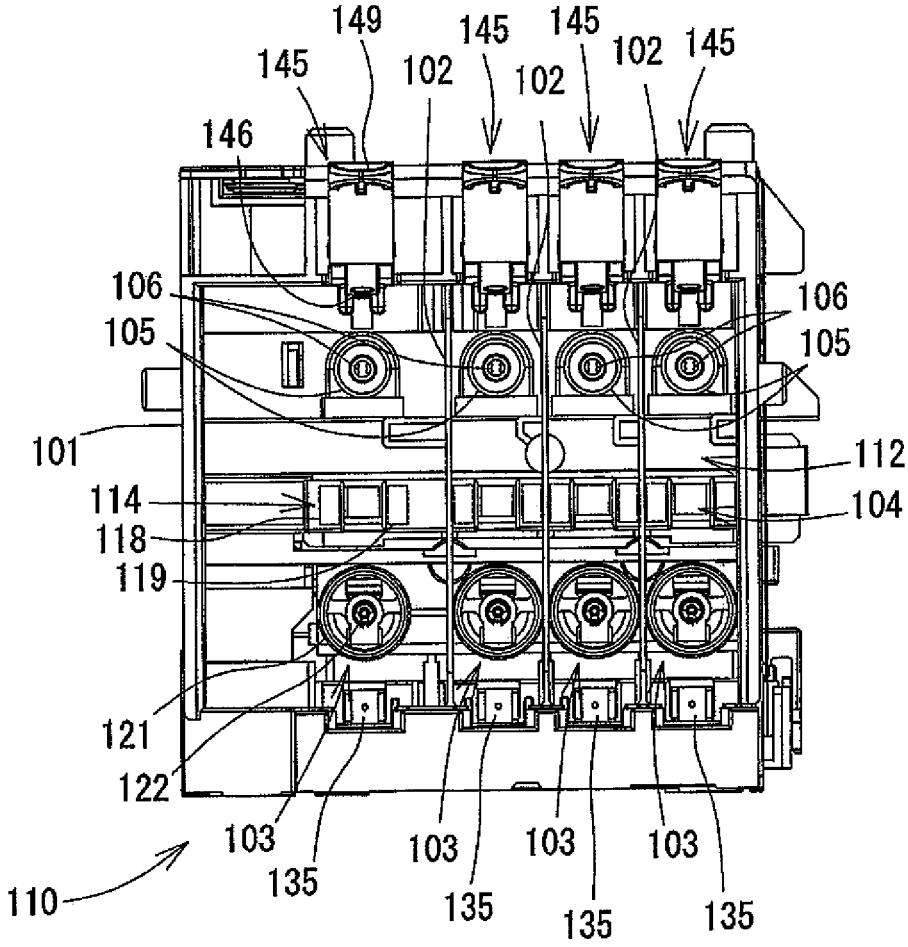
FIG. 5 is a plan view of the cartridge mounting portion.

As shown in FIGS. 4 through 6, a casing 101 for housing the cartridge mounting portion 110 therein is formed with an opening 112 in the front side of the printer 10. Through the opening 112, the ink cartridge 30 is inserted into and removed from the casing 101. The casing 101 accommodates four ink cartridges 30 storing cyan, magenta, yellow and black ink.

Three partitioning plates 102 are installed in the inner space of the casing 101 at a depth side from the opening 112 of the casing 101. The partitioning plates 102 are provided for partitioning the inner space of the casing 101 into four rooms. The above-mentioned four ink cartridges are individually accommodated in the four rooms of the casing 101.

As shown in FIG. 5, four ink joint portions 103 are provided in association with the four ink cartridges 30 accommodated in the casing 101 at the lower portion on the peripheral surface of the casing 101. The ink joint portions 103 are arranged at positions corresponding to the positions of the ink supply portions 37 of the ink cartridges 30.

Each ink joint portion 103 includes an ink needle 122 and a holding portion 121. The ink needle 122 is a tubular shape and made from resin. The ink needle 122 is connected to an ink tube 20 at an outer surface of the casing 101. The ink tube 20 extends upward on the outer surface of the casing 101 and then further extends and connected to the recording head 21 of the printer 10.

The holding portion 121 is of a cylindrical shape. The ink needle 122 is disposed at the center of the holding portion 121. The ink supply portion 37 is inserted into the holding portion 121 while the outer peripheral surface of the ink supply portion 37 is guided by the inner peripheral surface of the holding portion 121 when the ink cartridge 30 is mounted in the cartridge mounting portion 110. Insertion of the ink supply portion 37 into the holding portion 121 results in insertion of the ink needle 122 into the ink supply port 71, thereby allowing ink stored in the ink chamber 36 to flow into the ink needle 122.

As shown in FIG. 6, a sensor unit 104 is disposed on the peripheral surface of the casing 101 at a position above the ink joint portion 103. The sensor unit 104 includes a substrate 113 and four optical sensors 114 mounted thereon. The four optical sensors 114 are provided corresponding to the four ink cartridges 30. The optical sensors 114 are aligned in the widthwise direction of the casing 101 and each optical sensor is disposed in each room partitioned by the partitioning plates 102.

Each optical sensor 114 includes a light emitting element 118, such as LED, and a light receiving element 119, such as photo-transistor. The light emitting element 118 and the light receiving element 119 are surrounded by a horseshoe shaped housing. The light emitting element 118 is disposed to emit light in a selected direction, and the light receiving element 119 is disposed to receive the light from the light emitting element 118. Specifically, the light emitting element 118 and the light receiving element 119 are disposed in spaced-apart and in confronting relation within the horseshoe shaped housing. The residual ink amount detector 33 provided in the ink cartridge 30 is capable of entering into the space between the light emitting element 118 and the light receiving element 119. Entry of the residual ink amount detector 33 into the light path of the optical sensor 114 changes light transmission from the light emitting element 118 to the light receiving element 119.

The residual ink amount detector 33 is either in a first state or a second state when the ink cartridge 30 is inserted into the cartridge mounting portion 110. In the first state, the residual ink amount detector 33 allows a predetermined amount of light to pass therethrough whereas in the second state, the residual ink amount detector 33 interrupts or attenuates the light so that the light receiving element 119 receives less than the predetermined amount of light. An infrared ray emitting diode may be used as a light emitting element.

As shown in FIG. 5, air channel joints 105 are provided at the upper position on the peripheral surface of the casing 101. The air channel joints 105 are disposed in positions corresponding to the air holes 38 of the ink cartridges 30. In this embodiment, four air channel joints 105 are provided corresponding to the four ink cartridges 30 to be accommodated in the casing 101.

The air channel joint 105 is substantially of a hollow cylindrical shape that projects from the front wall of the casing 101 toward the opening 112. A through-hole 106 is formed at the projected tip end of the air channel joint 105. In mounting the ink cartridge 30 in the cartridge mounting portion 110, the air channel joint 105 advances into the opening 35 of the cover 32 and the projected end of the air channel joint 105 is inserted into the resilient block 80 disposed in the air hole 38. At this time, the outer surface of the air channel joint 105 is brought into intimate contact with the inner surface of the resilient block 80. Upon the outer surface of the air channel joint 105 being in contact with the resilient block 80, the rod 79 of the atmosphere-communication valve 75 is pushed into the resilient block 80 against the urging force of the coil spring 78 by the aid of the projected end of the air channel joint 105, resulting in opening of the air-communication port 76. With such a configuration, air is introduced into the ink chamber 36 from the through-hole 106 of the air channel joint 105 via the air-communication port 76 and the air channel 77. Since the inner surface of the resilient block 80 is in intimate contact with the outer surface of the air channel joint 105, air and/or ink are prevented from being leaked from the contacted portion.

As shown in FIG. 6, the slide member 135 is provided in a space 130 formed in the depth side lower portion of the cartridge mounting portion 110. In accordance with this embodiment, four slide members 135 are provided corresponding to the four ink cartridges 30 to be accommodated in the casing 101. The space 130 is continuous with the inner space of the cartridge mounting portion 110. The slide member 135 is supported by a supporting rod within the space 130 to be slidably movable in the cartridge removing direction 55 and the cartridge insertion direction 56. The slide member 135 is generally a rectangular parallelepiped in its outer appearance. The slide member 135 is disposed in an insertion path of the second arm 46 of the ink cartridge 30 and is configured to abut against the tip end of the second projection 46. In other words, the slide member 135 is disposed in confrontation with the tip end of the second projection 46 in the cartridge insertion direction 56.

A coil spring 139 is provided in the space 130 to urge the slide member 135 toward the opening 112. That is, the ink cartridge 30 is resiliently urged in the direction in which the cartridge 30 is removed from the cartridge mounting portion 110 or in the direction toward the opening 112. The coil spring 139 is disposed around the outer periphery of the supporting rod 133 extending in the cartridge insertion direction 56 within the space 130. Specifically, the coil spring 139 is interposed between the end wall 131 of the space 130 and the slide member 135. When the coil spring 139 is in its natural length, no external force is applied to the slide member 135 and the latter is in a prescribed position at the side of opening 112. In the course of mounting of the ink cartridge 30 in the cartridge mounting portion 110, the second projection 46 of the ink cartridge 30 is brought into abutment with the slide member 135 to thereby push the slide member 135 toward the end wall 131 of the space 130, thereby compressing the coil spring 139 and slidably moving the slide member 135 toward the end wall 131. The compressed coil spring 139 urges the ink cartridge 30 toward the cartridge removing direction 55 via the slide member 135.

A lock lever 145 is provided in the casing 101. The lock lever 145 serves to maintain the ink cartridge to stay at the cartridge mounting portion 110 against the urging force of the coil spring 139. The lock lever 145 is disposed at the upper position of the opening 112 formed in the casing 101. In this embodiment, four lock levers 145 are provided corresponding to the four ink cartridges 40 to be accommodated in the casing 101.

The lock lever 145 is of an arm shaped. A supporting shaft 147 is provided near the center of the lock lever 145 which is supported on the casing 101. With such a configuration, the lock lever 145 is supported on the supporting shaft 147 to be rotatable thereabout. The lock lever 145 includes an operation part 149 and an engaged part 146. The operation part 149 projects outside from the opening 112 of the casing 101. The operating part 149 is used when rotating the lock lever 145. The engaged part 146 is interposed within the casing 101 and is configured to engage the engagement portion 43 of the ink cartridge 30. Engagement of the engagement portion 43 with the engaged part 146 maintains the ink cartridge 30 urged by the coil spring 139 at the mounted condition. The lock lever 145 is brought to a lock position when the engagement portion 43 engages the engaged part 146. When the engagement portion 43 does not engage the engaged part 146, the lock lever 145 is in an unlocked position.

A coil spring 148 is attached to the lock lever 145. The lock lever 145 is urged toward the lock position by virtue of the coil spring 148. When the operating part 149 is pushed downward when the lock lever 145 is in the lock position, the lock lever 145 is rotated from the lock position to the unlocked position.

As shown in FIG. 6, the internal space of the air channel joint 105 is formed with an atmosphere communicable room 107. The room 107 extends from the through-hole 106 of the air channel joint 105 to the end of the air channel joint 105 in the cartridge insertion direction 56. Four air channel joints 105 are provided corresponding to four air holes 38 of the respective ink cartridges 30 to be accommodated in the casing 101 such that the rooms 107 are formed to be mutually independent one from the other.

Figure 7:
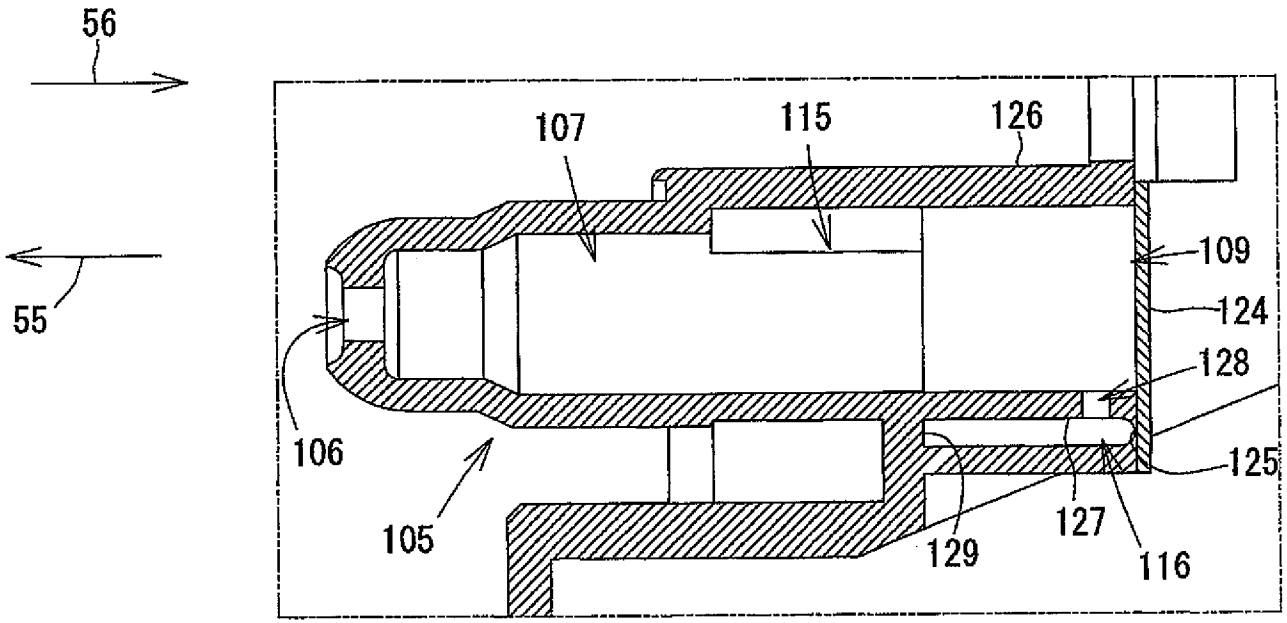
FIG. 7 is an enlarged view showing a region VII encircled by two-dotted-chain line in FIG. 6.

As shown in FIG. 7, the atmosphere communicable room 107 is formed with an opening 109 at a side opposite the through-hole 106. The opening 109 is formed in the end face of a peripheral wall 126 defining the atmosphere communicable room 107 and extending in the cartridge insertion direction 56. The atmosphere communicable room 107 is further defined by a partitioning wall 127 extending in the cartridge insertion/removing directions 56, 55. The partitioning wall 127 partitions the atmosphere communicable room 107 into the first room 115 at the upper side of the atmosphere communicable room 107 and the second room 116 at the lower side of the atmosphere communicable room 107. The first room 115 is a space continuous with the through-hole of the air channel joint 105 and extends to the through-hole 106. The cross-sectional area in the inner surface of the first room 115 increases stepwise toward the membrane 124.

The second room 116 is disposed at the lower side of the through-hole 106 of the air channel joint 105 and also at the lower side of the first room 115. The second room 116 is not directed fluidly communicable with the through-hole 106 of the air channel joint 105 but extends toward the opening 109. The second room 116 is an air containing space with which air is filled.

The partitioning wall 127 is formed with an opening or a connecting path 128 vertically penetrating the partitioning wall 127. The connecting path 128 fluidly connects the first room 115 and second room 116 to allow air and ink to flow into the first room 115 from the second room 116 and vice versa. In the second room 116, the connecting path 128 is formed at a position remote from an end surface 129 of the second room 116 but close to the opening 109.

The opening 109 defined by the end face of the peripheral wall 126 is sealed with an air-permeable and liquid-impermeable membrane (hereinafter referred to as "semi-permeable membrane") 124. The membrane 124 is made from a porous material having a number of minute holes therein. Fluorocarbon polymers are preferable as a material for the membrane, such as polytetrafluoroethylene, polychlorotrifuoroethylene, tetrafluoroethylene-hexafluoropropylene copolymer, tetrafluoroethylene-perfluoroalkylvinylether copolymer, tetrafluoroethylene-ethyline copolymer.

Due to the semi-permeable membrane 124 sealing the opening 109, the latter is sealed so as not to pass liquid therethrough. On the other hand, the membrane 134 allows air to pass therethrough. An amount of air passing therethrough depends on Gurley number of the membrane 124. More specifically, an amount air (or fluid amount) capable of passing through the opening 103 per a unitary time is determined depending upon the Gurley number of the membrane 134 and is proportional to an area of the membrane 124 corresponding to the size of the opening 109, i.e., effective area of the membrane 134. Accordingly, the amount of air capable of passing the semi-permeable membrane 124 increases as the effective area of the semi-permeable membrane 124 increases or as the area of the opening 109 to be sealed with the semi-permeable membrane 124 increases. In other words, the air permeable rate of the semi-permeable membrane 124 is determined depending upon the Gurley number of the semi-permeable membrane 124 and the effective or operating area of the semi-permeable membrane 124.

The semi-permeable membrane 124 is fixedly secured to the end face of the peripheral wall 126 and to the partitioning wall 127 by welding. The peripheral wall 126 and the partitioning wall 127 are formed by molding synthetic resin, such as polystyrene, polypropylene. The semi-permeable membrane 124 is affixed to the peripheral wall 126 and the partitioning wall 127 using thermal or high-frequency welding. In performing the welding, the edges of the peripheral wall 126 and the partitioning wall 127 are melted and protrude toward the second room 116. The melted and protruded resin covers the region 125 of the semi-permeable membrane 124 facing the second room 116. This region 125 of the semi-permeable membrane 124 prevents liquid and gas from passing therethrough. In other words, other than the connecting path 128, there are no channels in the second room 116 for allowing ink and gas to pass therethrough.

[Mounting of Ink Cartridge 30]

Referring to FIG. 6, mounting operation of the ink cartridge 30 into the cartridge mounting portion 110 will be described.

Although not shown in the figure, the opening 112 of the cartridge mounting portion 110 is closed by the cover provided in the housing of the printer 10. When mounting the ink cartridge 30 into the cartridge mounting portion 110, the cover of the housing is opened.

As shown in FIG. 6, the mounting operation of the ink cartridge 30 begins with moving the ink cartridge 30 in the cartridge insertion direction 56, and then is inserted into the cartridge mounting portion 110. When the ink cartridge 30 is inserted into the cartridge mounting portion 110, a slanted guide surface formed in the leading end of the cover 32 and slanted downward toward the leading end of the cover 32 is brought into abutment with the engaged portion 146 of the lock lever 145. When the ink cartridge 30 is further inserted into the cartridge mounting portion, the engaged portion 146 of the lock lever 145 runs on the cover 32, resulting in rotating the lock lever 145 counterclockwise to move from the locked position to the unlocked position as shown in FIG. 6. Also, the leading edge of the second projection 46 of the ink cartridge 30 is brought in abutment with the slide member 135. At this time, the slide member 135 is positioned at the side of the opening within the space 130 due to the urging force imparted by the coil spring 139. From the condition shown in FIG. 6, the user pushes the rear wall of the cover 32 against the urging force of the coil spring 139 in order to further insert the ink cartridge 30 into the cartridge mounting portion 110.

When the engagement portion 43 of the ink cartridge 30 has reached ahead of the engaged portion 146 with respect to the cartridge insertion direction 56, the lock lever 146 is rotated clockwise to move from the unlock position to the lock position. Then, the engaged portion 146 of the lock lever 145 and the engagement portion of the ink cartridge 30 are brought into engagement with each other. The ink cartridge 30 is held in the mounting position against the urging force of the coil spring 139.

When the ink cartridge 30 is held in the mounting position, the ink needle 122 is inserted into the ink supply port 71 of the ink cartridge 30. The ink supply valve 70 is moved to the open position by virtue of the ink needle 122. As a result, ink is capable of flowing out from the ink chamber 36 to the ink tube 20 through the ink channel 72 and ink needle 122. The air channel joint 105 provided in the casing 101 opens the atmosphere-communication valve 75, so that the interior of the ink chamber 36 becomes atmospheric pressure. That is, air is introduced into the ink chamber 36 from the semi-permeable membrane 124 through the atmosphere communicable room 107, through-hole 106, air-communication port 76, and air channel 77.

The residual ink amount detector 33 is moved to a position indicating the level of ink stored in the ink chamber 36 and the position of the residual ink amount detector 33 is detected by the optical sensor 114. Detection of the position of the indicator portion 62 of the sensor arm 60 indicates the residual amount ink remaining in the ink chamber 36.

When ink stored in the ink chamber 36 is consumed as a result of ejection of ink droplets, air is introduced into the ink chamber 36. The amount of air introduced thereinto corresponds to the amount of ink consumed. The air hole 38 is communicable with atmosphere through the atmosphere communicable room 107 and the semi-permeable membrane 124. As such, air can be introduced into the ink chamber 36 through these channels as far as air permeability of the semi-permeable membrane 124 is preserved.

In the event of occurrence of paper jam or packaging of the inkjet printer 10, the latter may be placed upside down or one side of the inkjet printer 10 may be lifted to place the printer 10 in a vertical posture while mounting the ink cartridge 30 in the cartridge mounting portion 110. If the inkjet printer 10 is held in such a posture that the air-communication port 76 faces downward or the air hole 38 is positioned lower than the ink supply portion 37, ink may flow into the atmosphere communicable room 107 from the ink chamber 36 through the air channel 77 and air-communication port 76. However, due to the semi-permeable membrane 124 sealing the opening 109 of the atmosphere communicable room 107, ink does not flow out from the opening 109 of the atmosphere communicable room 107. Should ink flow out from the opening 109, electronic components, such as the sensor unit 104, may be smeared with the leaked ink.

Figure 8B:
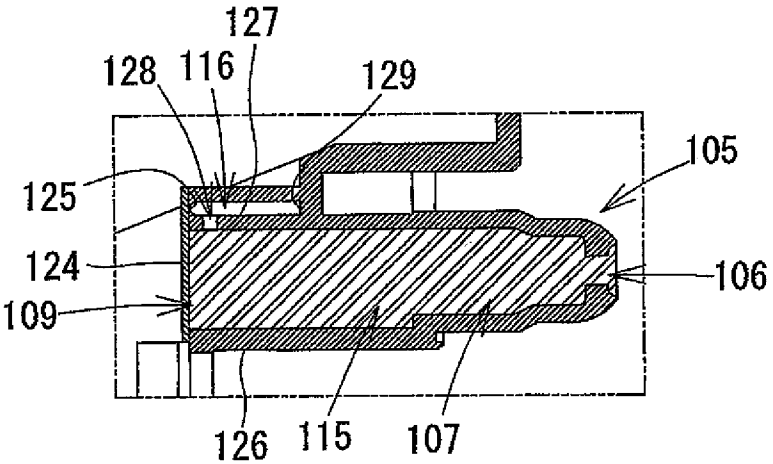
FIG. 8B is an enlarged cross-sectional view showing an orientation of an atmosphere-communicating nozzle when the inkjet printer is held upside down.
Figure 8A:
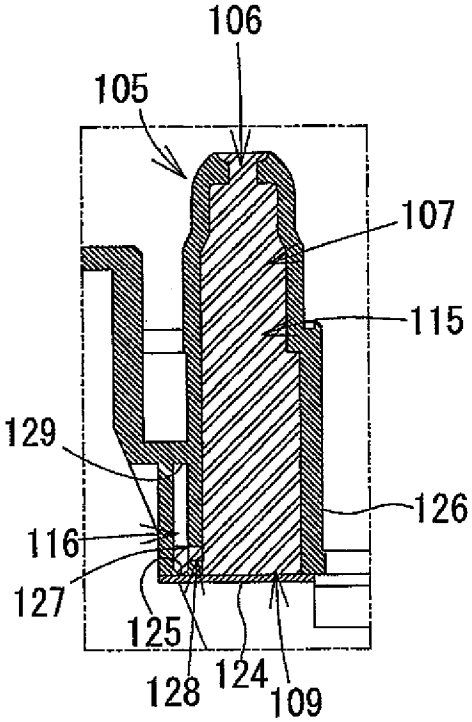
FIG. 8A is an enlarged cross-sectional view showing an orientation of an atmosphere-communicating nozzle when the inkjet printer is held vertically.

When the printer 10 is placed in such a posture that the air hole 38 of the ink cartridge 30 faces downward, the through-hole 106 of the air channel joint 105 faces upward as shown in FIG. 8A. It is to be noted that in FIG. 8A, illustration of the ink cartridge 30 is omitted and thus the air hole 38 is not shown. If ink flows into the first room 115 from the ink chamber 36 through the air-communication port 76, ink is brought into contact with the semi-permeable membrane 124 at the lowermost position. The boundary surface of the ink will gradually approach to the through-hole 106. When the boundary surface of the ink has reached the connection channel 128 formed in the partitioning wall 127, ink also flows into the second room 116 through the connection channel 128. When the ink boundary surface raises above the connection channel 128, air is confined in a space just below the inner side surface 129 of the second room 116. Hence, ink does no longer flow from the first room 115 to the second room 116. As such, the second room 116 functions as an air retaining space or air reservoir.

When the posture of the printer 10 is returned to a normal state from the posture shown in FIG. 8A, the second room 116 is positioned below the first room 115. Air stayed in the second room 116 moves into the first room 115 through the connection channel 128. Then, air moves along the inner surface of the peripheral wall 126 to the opening 109 and finally brought into contact with the semi-permeable membrane 124. Contact of air with the semi-permeable membrane 124 quickly recovers air-permeability of the membrane. Air starts flowing into the atmosphere communicable room 107 through the air-contacted region on the semi-permeable membrane 124 and then ink starts returning to the ink chamber 36 through the through-hole 106 of the air channel joint 105. Once ink starts returning to the ink chamber 36, ink does no longer cling to the semi-permeable membrane 124 on an area other than the air-contacted region and the air permeability on this area is also recovered.

When the inkjet printer 10 is placed in such a posture in which the air hole 38 of the ink cartridge 30 is positioned below the ink supply port 37, the second room 116 is positioned above the first room 115 as shown in FIG. 8B. When ink flows into the first room 115 through the air-communication port 76, the ink boundary surface gradually raises toward the partitioning wall 127. Even if the ink boundary surface is elevated above the through-hole 106 in the first room 115, the semi-permeable membrane 124 allows air to pass therethrough until the ink boundary surface has reached the partitioning wall 127. Air confined in the first room 115 is discharged out to atmosphere through the semi-permeable membrane 124 and ink further flows into the first room 115 from the through-hole 106. When the ink boundary surface has reached the connection channel 128 formed in the partitioning wall 127, air moved into and is confined in the second room 116. Hence, ink does not flow into the first room 115 through the through-hole 106. As described previously, the region in the second room 116 where the semi-permeable membrane 124 faces is covered with resin and air is incapable of transmitting therethrough. Therefore, there is no channel from which air is discharged from the second room 116. In this way, the second room 116 functions as an air retaining space or air reservoir When the posture of the printer 10 is returned to the normal printable state from the state shown in FIG. 8B, the second room 116 is positioned below the first room 115. Hence, air staying in the second room 116 moves into the first room 115 through the connection channel 128. Air further moves along the inner surface of the peripheral wall 126 toward the opening 109. Air is then brought into contact with the semi-permeable membrane 124.

In accordance with the above-described embodiment, the second room 116 is provided in the atmosphere communicable room 107 to serve as an air reservoir. The semi-permeable membrane 124 is affixed to seal the atmosphere communicable room 107. Air is confined in the second room 116 even if an eventual ink flow occurs from the ink chamber 36 to the atmosphere communicable room 107 through the air, channel 77. Such an eventual ink flow results from, for example, inclination of the inkjet printer 10. When the inkjet printer 10 is returned to the normal printable posture, the air staying in the second room 116 is brought into contact with the semi-permeable membrane 124. Air-contact portion of the semi-permeable membrane 124 quickly recovers the air permeability, allowing air to be introduced into the ink chamber 36 through the semi-permeable membrane 124. Accordingly, ink droplets can be smoothly ejected from the nozzles formed in the recording head 21 and thus ink ejection failure can be effectively prevented.

As described, the second room 116 and the connection channel 128 formed in the partitioning wall 127 functions as a characteristic recapture enhancement section operating to enhance recapturement of the air-permeability of the semi-permeable membrane 124. The characteristic recapture enhancement section is operable when ink from the ink chamber 36 clings to the semi-permeable membrane 124.

Next, a modification of the embodiment described above will be described. In this modification, the atmosphere communicable room 107, opening 109 and semi-permeable membrane 124 are provided in the ink cartridge 30 unlike the above-described embodiment in which these components are provided in the cartridge mounting portion 110.

Figure 9:
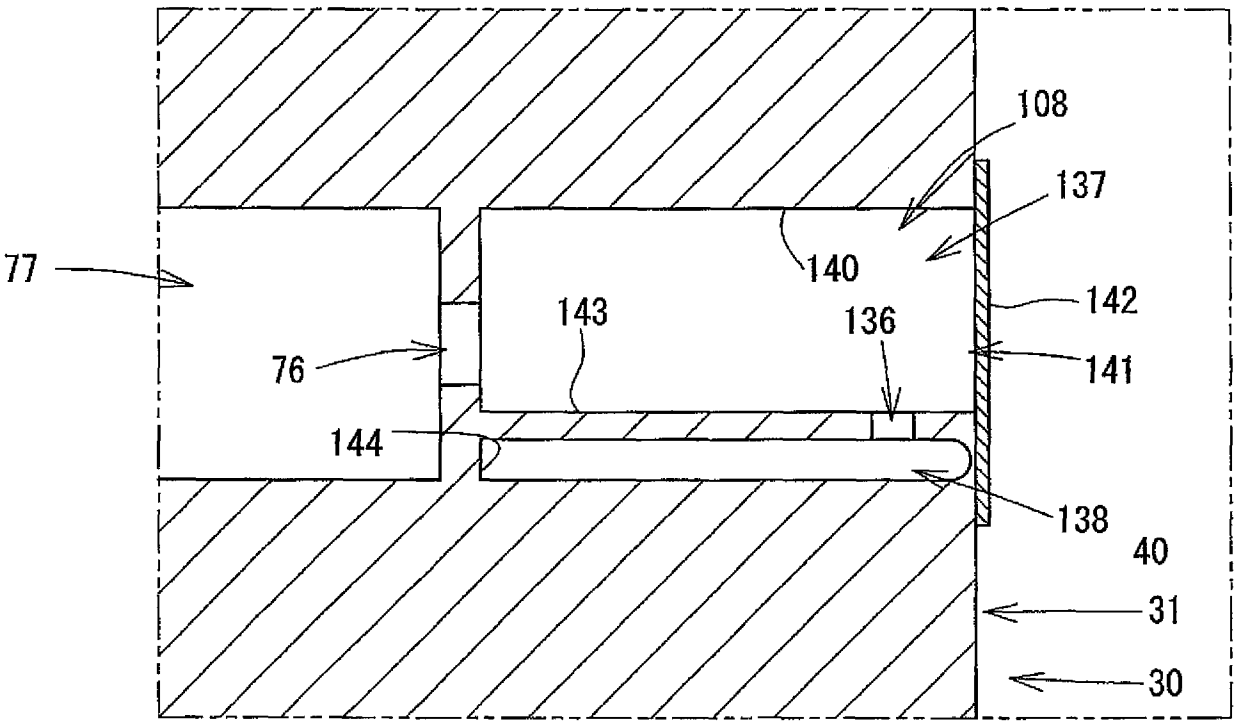
FIG. 9 is a partial enlarged view of an ink cartridge according to a modification of the embodiment.

More specifically, as shown in FIG. 9, an atmosphere communicable room 108 is provided in the main unit 31 of the ink cartridge 30 in a position close to the front wall 40 of the main unit 31. The room 108 is fluidly connected to an air channel 77 and air-communication port 76. The atmosphere communicable room 107 is defined by a peripheral wall 140 and has an opening 141 at the front wall 40 of the main unit 31. Gas-permeable and liquid-impermeable membrane (semi-permeable membrane) 142 is affixed to the opening 141 to seal the same. The room 108 is partitioned by a partitioning wall 143 to a first room 137 and a second room 138. Ink and air can be communicable between the first room 137 and the second room 138 through a connection channel 136 formed in the partitioning wall 143. The connection channel 136 is formed in a position further from rear side wall 144 of the second room 138 than another side wall close to the semi-permeable membrane 142. When the semi-permeable membrane 142 is affixed to the end faces of the peripheral wall 140 and the partitioning wall 143 by welding, the thermoplastic resin used for molding the peripheral wall 140 and the partitioning wall 143 is melted and the melted resin seals the opening of the second room 138 facing the semi-permeable membrane 142. Hence, air is incapable of entering into and flowing out from the second room 138 through the front end portion.

In accordance with the above-described modification, the second room 138 is provided in the room 108 to serve as an air reservoir. The semi-permeable membrane 142 is affixed to seal the room 108. Air stays in the second room 138 even if an eventual ink flow occurs from the ink chamber 36 to the room 108 through the air channel 77. Such an eventual ink flow results from, for example, inclination of the printer 10. When the printer 10 is returned to the normal printable posture, the air remaining in the second room 138 is brought into contact with the semi-permeable membrane 142. Air-contact portion of the semi-permeable membrane 142 quickly recovers the air permeability, allowing air to be introduced into the ink chamber 36 through the semi-permeable membrane 142. Accordingly, ink can be smoothly flowed out from the ink chamber 36 and thus ink ejection failure in the recording head 21 can be effectively prevented.

While the invention has been described in detail with reference to the embodiments thereof, it would be apparent to those skilled in the art that various changes and modifications may be made therein without departing from the spirit of the invention.

What is claimed is:

1. An ink cartridge comprising:

an ink chamber storing ink therein;

an ink supply portion provided in the ink chamber;

an air channel connected to the ink chamber and configured to introduce air into the ink chamber;

a room wall defining an atmosphere communicable room connected to the air channel, the room wall being formed with an opening open to atmosphere;

a membrane sealing the opening of the room wall, the membrane having a gas-permeable and liquid-impermeable characteristic; and an air reservoir connected to the atmosphere communicable room, the air reservoir configured to retain air confined in the atmosphere communicable room when ink flows into the atmosphere communicable room from the ink chamber, the air in the air reservoir being released toward the membrane when the ink is about to return to the ink chamber.

2. The ink cartridge according to claim 1, wherein the air reservoir is disposed in a position lower than a connecting portion of the atmosphere communicable room and the air channel when ink stays in the ink chamber.

3. The ink cartridge according to claim 2, further comprising a partitioning wall that partitions the atmosphere communicable room to a first room and a second room, the second room being communicable with the first room through a communication channel and retaining air confined in the first room when ink flows into the first room from the ink chamber, the air in the second room being released toward the membrane when the ink is about to return to the ink chamber.

4. The ink cartridge according to claim 3, wherein the membrane is in contact with the partitioning wall and faces both the first room and the second room, the second room having a first side wall and a second side wall, the first side wall facing the membrane and being shielded to have communication with atmosphere disabled.

5. The ink cartridge according to claim 4, wherein the communication channel connecting the first room and the second room is further in position from the second wall than the first wall.

6. The ink cartridge according to claim 3, wherein the room wall and the partitioning wall are made from a thermoplastic resin, the membrane being welded to both the room wall and the partitioning wall to seal the opening of the room wall, the first side wall of the second room being formed by the thermoplastic resin melted from the room wall and the partitioning wall when welding the membrane.

7. The ink cartridge according to claim 3, wherein the first room has an inner surface, a cross-sectional area of the inner surface increasing stepwise toward the membrane.

8. The ink cartridge according to claim 1, wherein the membrane is made from a fluorocarbon polymer.

9. The ink cartridge according to claim 1, wherein the atmosphere communicable room is disposed above the air reservoir when the ink cartridge is positioned in a posture to be mounted on a cartridge mounting portion.

10. An inkjet recording apparatus comprising:

a recording head;

an ink cartridge having an ink chamber storing ink therein, an ink supply portion provided in the ink chamber and connected to the recording head, and an air channel connected to the ink chamber and configured to introduce air into the ink chamber;

a cartridge mounting portion in which the ink cartridge is detachably mounted; and a room wall defining an atmosphere communicable room connected to the air channel, the room wall being formed with an opening open to atmosphere;

a membrane sealing the opening of the room wall, the membrane having a gas-permeable and liquid-impermeable characteristic; and an air reservoir connected to the atmosphere communicable room, the air reservoir configured to retain air confined in the atmosphere communicable room when ink flows into the atmosphere communicable room from the ink chamber, the air in the air reservoir being released toward the membrane when the ink is about to return to the ink chamber.

11. The inkjet recording apparatus according to claim 10, wherein the air reservoir is disposed in a position lower than a connecting portion of the atmosphere communicable room and the air channel when ink stays in the ink chamber.

12. The inkjet recording apparatus according to claim 11, further comprising a partitioning wall that partitions the atmosphere communicable room to a first room and a second room, the second room being communicable with the first room through a communication channel and retaining air confined in the first room when ink flows into the first room from the ink chamber, the air in the second room being released toward the membrane when the ink is about to return to the ink chamber.

13. The inkjet recording apparatus according to claim 12, wherein the membrane is in contact with the partitioning wall and faces both the first room and the second room, the second room having a first side wall and a second side wall, the first side wall facing the membrane and being shielded to have communication with atmosphere disabled.

14. The inkjet recording apparatus according to claim 13, wherein the communication channel connecting the first room and the second room is further in position from the second wall than the first wall.

15. The inkjet recording apparatus according to claim 12, wherein the room wall and the partitioning wall are made from a thermoplastic resin, the membrane being welded to both the room wall and the partitioning wall to seal the opening of the room wall, the first side wall of the second room being formed by the thermoplastic resin melted from the room wall and the partitioning wall when welding the membrane.

16. The inkjet recording apparatus according to claim 12, wherein the first room has an inner surface, a cross-sectional area of the inner surface increasing stepwise toward the membrane.

17. The inkjet recording apparatus according to claim 10, wherein the membrane is made from a fluorocarbon polymer.

18. The inkjet recording apparatus according to claim 10, wherein the atmosphere communication room is provided in the cartridge mounting portion.

19. The inkjet recording apparatus according to claim 10, wherein the atmosphere communicable room is disposed above the air reservoir when the ink cartridge is positioned in a posture to be mounted on a cartridge mounting portion.

* * * * *